United States Patent [19]

Baillie et al.

[11] 4,326,307

[45] Apr. 27, 1982

[54] RELEASABLE TOILET SEAT CLAMP

[76] Inventors: Kenneth D. Baillie; J. Donald Lafontan, both of 840 W. 64th Ave., Vancouver, B.C., Canada, V6P 2L4

[21] Appl. No.: 114,259

[22] Filed: Jan. 22, 1980

Related U.S. Application Data

[63] Continuation-in-part of Ser. No. 911,970, Jun. 2, 1978, abandoned.

[51] Int. Cl.[3] ..... A47K 13/12

[52] U.S. Cl. ..... 4/236; 4/240; 16/38; 16/257; 16/252; 24/217 R

[58] Field of Search ..... 4/234–237, 4/239, 240; 16/38, 149, 171; 24/217 R

[56] References Cited

U.S. PATENT DOCUMENTS

| | | | |
|---|---|---|---|
| 2,004,023 | 6/1935 | Uffen | 4/240 |
| 2,204,100 | 6/1940 | Cook | 4/236 |
| 2,440,170 | 4/1948 | Dufrene | 24/217 X |
| 3,006,673 | 10/1961 | Swick | 16/38 |
| 3,038,170 | 6/1962 | Turek et al. | 4/236 |
| 3,055,015 | 9/1962 | Silverman | 4/240 |
| 3,063,063 | 11/1962 | Brooks | 4/236 |
| 3,248,995 | 5/1966 | Meyer | 24/217 R |
| 3,550,164 | 12/1970 | Pease | 4/236 |
| 3,613,130 | 10/1971 | Sansone | 4/240 |
| 3,916,756 | 11/1975 | Yoda | 24/217 R X |
| 4,079,471 | 5/1978 | Corda | 4/236 X |
| 4,159,548 | 7/1979 | Hewson | 4/236 |

FOREIGN PATENT DOCUMENTS

| | | | |
|---|---|---|---|
| 523278 | 3/1956 | Canada | 24/217 R |
| 712307 | 6/1965 | Canada . | |
| 754803 | 3/1967 | Canada . | |
| 364087 | 8/1906 | France | 24/217 R |

*Primary Examiner*—Stuart S. Levy

*Attorney, Agent, or Firm*—Sixbey, Friedman & Leedom

[57] ABSTRACT

A clamp is provided for detachably securing a toilet seat to a toilet bowl. A spherically headed bolt is securely bolted into each of the holes in the flange portion of the rear of the upper part of the bowl so that the spherical head of the post extends out beyond the upper part of the bowl. Fasteners, each having downwardly depending wall circumscribing a socket for mateably receiving one of these projections and securing it therein against unpurposeful disengagement, are associated with the toilet seat, and may rotatably engage the hinge shaft found to the rear of many types of toilet seats. By lifting on a finger grip ledge extending out at the rear of each of the fasteners, the fasteners and the bolt heads are disengaged, thereby detaching the toilet seat from its position on the top part of the bowl. This device, by permitting such easy disengagement of the toilet seat, facilitates cleaning and hygiene.

6 Claims, 3 Drawing Figures

RELEASABLE TOILET SEAT CLAMP

BACKGROUND OF THE INVENTION

This is a continuation-in-part of our U.S. application Ser. No. 911,970 filed June 2nd, 1978, now abandoned.

This invention relates to a clamp for detachably securing a toilet seat to a toilet bowl, and more particularly relates to a toilet seat clamp which permits ready removal of the seat from its mounting on the toilet bowl, for example when it is desired to clean the toilet bowl or toilet seat-lid mechanism.

Modern day toilet seats, in North America, are often, if not usually, secured to the flanged portion about the top of the toilet bowl by means of posts, which are rotatably secured to the rear of the toilet seat. These posts are bolted through holes in the flanged portion of the toilet bowl at the rear thereof. While this type of assembly permits a toilet seat to be raised it does not permit the seat to be readily removed to facilitate cleaning at the rear of the toilet bowl, particularly around the area between these posts.

Toilet seat securing mechanisms which permit detachment of the toilet seat from its secured position on top of the toilet bowl by simply appropriately pulling on the toilet seat are known in the art. For example, U.S. Pat. Nos. 3,550,164 of J. W. Pease, issued Dec. 29, 1970, and 3,038,173 of J. R. Turek, et al., issued June 12, 1962 both describe magnetic fasteners which are secured to the toilet bowl and which releasably hold corresponding members associated with the toilet seat.

Cook, U.S. Pat. No. 2,204,100, issued June 11, 1940, describes an alternative toilet seat holder having U-shaped members which are secured to and extend from the tops of the posts which are bolted in the spaced holes in the flanged portion to the rear of the toilet bowl. These U-shaped members vertically receive the hinge shaft at the back of the toilet seat.

Brooks, U.S. Pat. No. 3,063,063, issued Nov. 13, 1962 describes and illustrates a further type of releasable toilet seat post coupling having a releasable post, which fits through the spaced holes in the flanged portion to the rear of the toilet bowl into a socket member which is bolted therebelow. This device requires a socket made from a number of components, as well as a carefully machined post which has a notch carefully formed and positioned to mate with a bearing which is held in the socket.

Other patents of general background interest are U.S. Pat. Nos. 3,613,130 of Sansome, issed Oct. 19, 1971; 3,248,170 of Meyers, issued May 3, 1968 and 2,440,170 of Duefrene, issued Apr. 20, 1948; Canadian Pat. Nos. 712,307 of Barlow, issued June 29, 1965; 754,803 of Fenton, issued Mar. 21, 1967 and 430,671 of Boersma, issued Oct. 16, 1945.

It is an object of the present invention to provide a simpler, hygienic, more economical quick action clamp for detachably securing a toilet seat to a toilet bowl than these prior art devices.

SUMMARY OF THE INVENTION

According to the present invention, a clamp is provided for detachably securing a toilet seat and lid to a toilet bowl having two spaced vertical holes in the flanged portion of the rear of the upper part of the bowl. Each clamp comprises a first member consisting of a spherically headed bolt and nut means to secure the bolt in seated engagement within one of the vertical holes so that the spherical head of the bolt projects out beyond the upper part of the bowl. The head of each of the bolts releasably mates with a socket formed on the lower surface of the top of a second, fastener member, associated with the toilet seat, by a downwardly depending circular wall, to secure it against unpurposeful disengagement. A finger grip means comprising a lip member rearwardly extending from the top of the fastener member is provided to facilitate disengagement of the clamp members. The fastener may further be provided with a means for rotatably engaging the hinge shaft located to the rear of the many types of toilet seats.

The clamp members may for example be molded from any appropriate durable, semi-rigid plastic or other suitable material.

The clamp according to the present invention permits ready disengagement of the toilet seat from the toilet bowl, merely by a quick upward pull on the fastener or on the rear of the toilet seat to disengage the two members. The members cooperate to securely hold the toilet seat in place until disengagement is desired. The spherical head of the bolt provides a regular, unbroken surface which promotes hygiene and cleanliness.

BRIEF DESCRIPTION OF THE DRAWINGS

Other objects and advantages of the present invention will become apparent upon reading the following detailed description and upon referring to the drawings in which.

In the Figures, similar features have been given similar reference numerals.

While the invention will be described in connection with example embodiments thereof, it will be understood that it is not intended to limit the invention to those embodiments. On the contrary, it is intended to cover all alternatives, modifications and equivalents as may be included within the spirit and scope of the invention as defined by the appended claims.

DETAILED DESCRIPTION OF THE INVENTION

Figure 2:
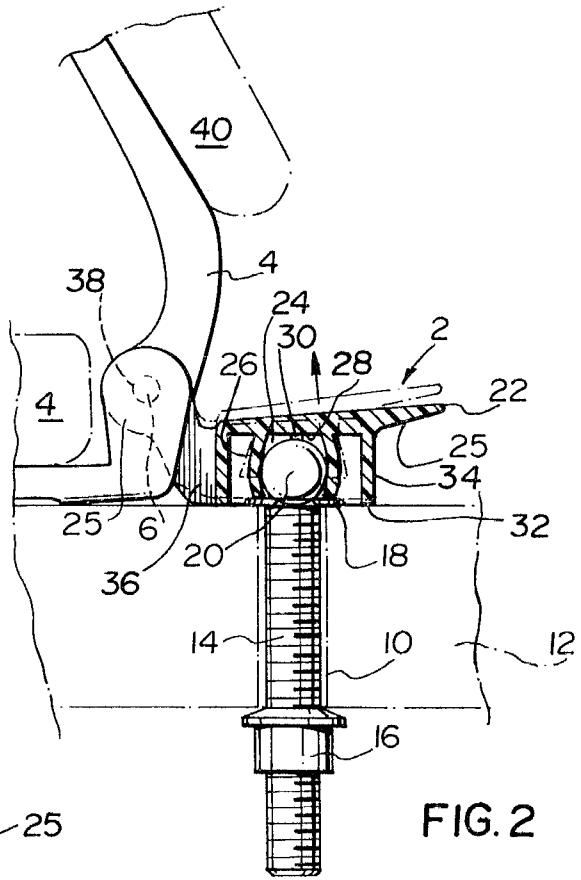
FIG. 2 is a section view along lines II—II of FIG. 1.
Figure 1:
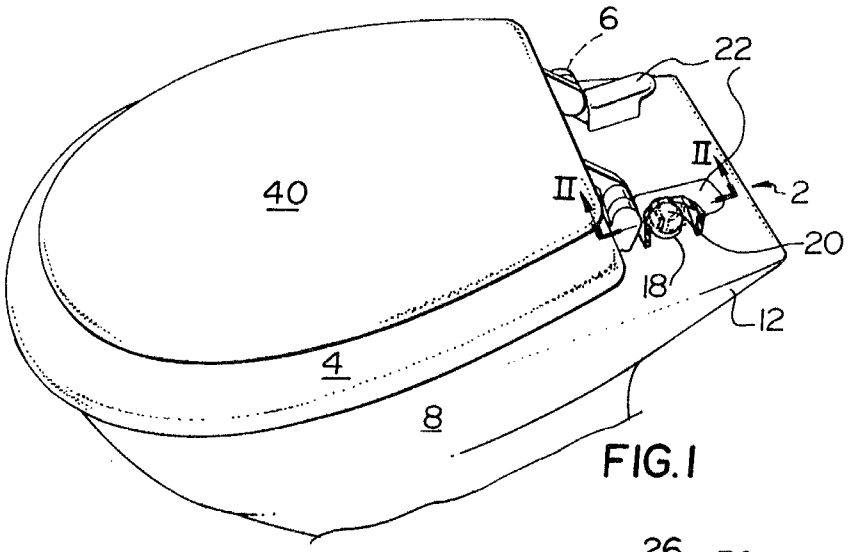
FIG. 1 is a perspective view of a section of a toilet bowl and toilet seat having a clamp according to the present invention, shown in attached arrangement.
Figure 3:
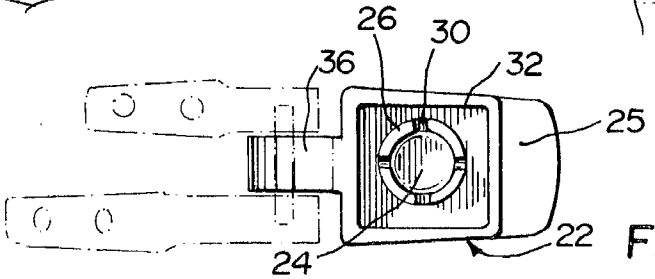
FIG. 3 is a plan view from below of the upper portion of the clamp of FIG. 1.

In FIGS. 1 and 2 there is shown a clamp 2 for detachably securing a toilet seat 4 with a hinge shafts 6 to a toilet bowl 8 having two spaced holes 10 in the flanged portion 12 of the upper part of the bowl. The clamp has a bolt 14 secured, by means of nut 16 and flange 18 (integrally secured to the bolt beneath head 20), firmly in position through flanged portion 12 of toilet bowl 8 (FIG. 2). The upper end of post 14 is formed into spherical head 20. A mating fastener 22 is provided having a socket 24 for releasably receiving spherical head 20 and securing it therein against unpurposeful disengagement. Socket 24 is located within circular wall 26 downwardly depending from the lower surface 28 of the top of fastener 22. Notches 30 are spaced in wall 26 to permit the use of semi-rigid materials in forming the fastener, the walls thereby providing sufficient rigidity to secure the bolt head within the socket, but providing sufficient give to enable disengagement or engagement of the bolt and fastener. For greater rigidity and security when the parts of the clamp are in mated position, the bottom edges 32 of sides 34 of fastener 22 rest on the upper surface of flanged portion 12 of the bowl. Also the lower edge of wall 26 is preferably formed so that it abuts and rests on the upper surface of flange 18 (FIG. 2).

To assist in gripping the fastener or in widening the socket of the fastener to facilitate release of the post projection therefrom, fastener 22 is provided with finger grip means 25 consisting of a lip rearwardly extending from the top of fastener 22. Fastener 22 is further provided with extension 36 and hole 38 therein for pivotably receiving hinge shaft 6 of toilet seat 4 and the toilet lid 40.

When it is desired to remove toilet seat 4 and its lid from position on top of toilet bowl 8, for example to clean or otherwise service the toilet bowl, an appropriate upward tug on finger grip means 25 or on the rear of the toilet seat 4 and lid 40 will disengage head 20 from fastener 22 to detach the seat and lid. Conversely, to reattach seat 4 and the lid to the top of toilet bowl 8, all that is required is to snap fastener 22 back into engagement with extension 20.

Thus it is apparent that there has been provided in accordance with the present invention a releasable toilet seat clamp that fully satisfies the objects, aims and advantages set forth above. While the invention has been described in cnjunction with an example embodiment thereof, it is evident that may alternatives, modifications and variations will be apparent to those skilled in the art in light of the foregoing description. Accordingly, it is intended to embrace all such alternatives, modifications and variations as fall within the spirit and broad scope of the appended claims.

We claim as our invention:

1. A clamp for detachably securing a toilet seat to a toilet bowl having spaced vertical holes in the flanged portion of the rear of the upper part of the bowl, the clamp comprising a first member consisting of a spherically headed bolt and nut means to secure the bolt in seated engagement within one of the vertical holes so that the spherical head of the bolt extends out beyond the upper part of the bowl, and a second, fastener member to be associated with the toilet seat to engage the bolt, the fastener member having a smooth top circumscribed by downwardly depending sides, the lower edges of the sides to rest in contact with the upper part of the bowl when the fastener is in engagement with the bolt to impart rigidity and stability to the clamp, the lower surface of the top of the fastener member further provided with a downwardly depending centrally disposed circular wall forming a socket, the downwardly depending circular wall is essentially rigid and provided with a plurality of notches piercing the wall and extending axially from the lower edge thereof, whereby the walls are provided with sufficient reesiliency to enable snapping the head of the bolt into engagement in the socket, or removal of the bolt therefrom, the head of the bolt and the socket of the fastener member being contoured for mating engagement for releasably securing the bolt and fastener member against unpurposeful disengagement; the fastener member being further provided with finger grip means to assist in intentional disengagement of the fastener means from the head of the bolt, the finger grip means being located at the rear of the top of the fastener member and laterally spaced with respect to the socket thereof, and comprising an extension of the top of the fastener member beyond the rear side thereof to provide a lip under which the fingers may be inserted for application of upward force to that portion of the fastener member, and wherein the bolt is further provided with a flange of circular periphery secured to the bolt immediately below its head, this flange to rest on the upper surface of the toilet bowl when the bolt is in position within one of the vertical holes through the flanged portion of the rear of the upper part of the bowl.

2. A clamp according to claim 1 wherein the upper surface of the flange and the bottom edge of the circular wall forming the socket are in abutting relationship when the fastener is in engagement with the bolt.

3. A clamp for detachably securing a toilet seat to a toilet bowl having spaced vertical holes in the flanged portion of the upper part of the bowl, said clamp comprising a first member and a second member, said first member including a bolt having a substantially spherical head with a regular, unbroken surface to facilitate the maintenance of said head in a sanitary condition and nut means for securing said bolt in seated engagement within one of the vertical holes so that the head of the bolt extends above the top surface of the upper part of the bowl, said second member to be associated with the toilet seat and including a smooth top portion circumscribed by downwardly depending sides, the lower edges of said sides to rest in secure contact with the top surface of the upper part of the bowl to impart rigidity and stability to said clamp, the lower surface of said top portion of said second member including a downwardly depending centrally disposed circular wall spaced inwardly from said sides to form a socket, the top surface of said second member further including an extension beyond the rear side of said second member laterally spaced with respect to said socket to form a lip, said socket of said second member and the head of said bolt of said first member being contoured for mating engagement so that said second member is releasably fastened to said first member when the head of said bolt is engaged by said socket; said socket further including a plurality of notches piercing said circular wall and extending axially from the lower edge thereof so that said wall has sufficient resiliency to provide secure engagement of the head of said bolt by said socket and ready disengagement of said head from said socket, said lip forming finger grip means for the application of upward force to said lip so that said socket may be intentionally disengaged from the head of said bolt.

4. The clamp described in claim 3, wherein said downwardly depending circular wall is formed of rigid material and said plurality of notches piercing said circular wall provide sufficient resiliency to enable the head of said bolt to be easily and quickly snapped into engagement and disengagement with said socket.

5. The clamp described in claim 3, wherein a flange of circular periphery is secured to said bolt immediately subjacent the head of said bolt, the lower surface of said flange to rest on the upper surface of the toilet bowl when said bolt is seated in one of the vertical holes in the flanged portion of the upper part of the bowl.

6. The clamp described in claim 5, wherein the upper surface of said flange and the bottom edge of said downwardly depending circular wall are in abutting relationship when said first member is engaged by said second member.

* * * * *